US006030739A

United States Patent [19]

Ishikawa et al.

[11] Patent Number: 6,030,739

[45] Date of Patent: Feb. 29, 2000

[54] ELECTROSTATIC IMAGE DEVELOPING TONER

[75] Inventors: Tomoko Ishikawa; Noriaki Takahashi; Takayuki Kanai, all of Yokohama, Japan

[73] Assignee: Mitsubishi Chemical Corporation, Tokyo, Japan

[21] Appl. No.: 09/260,011

[22] Filed: Mar. 2, 1999

[30] Foreign Application Priority Data

Mar. 3, 1998 [JP] Japan ..... 10-050377
Sep. 22, 1998 [JP] Japan ..... 10-267750

[51] Int. Cl.[7] ..... G03G 9/097
[52] U.S. Cl. ..... 430/110; 430/111
[58] Field of Search ..... 430/110, 111

[56] References Cited

U.S. PATENT DOCUMENTS 5,620,825 4/1997 Tavernier et al. ..... 430/110
5,712,074 1/1998 Sato et al. ..... 430/110
5,837,416 11/1998 Tavernier et al. ..... 430/111

FOREIGN PATENT DOCUMENTS 59-197048 11/1984 Japan ..... 430/110
3-155561 7/1991 Japan ..... 430/110

*Primary Examiner*—Roland Martin
*Attorney, Agent, or Firm*—Oblon, Spivak, McClelland, Maier & Neustadt, P.C.

[57] ABSTRACT

An electrostatic image developing toner containing a polysiloxane having the following repeating units (a) and (a)

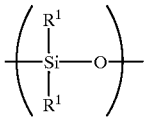

(b)

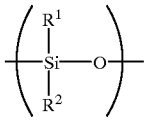

wherein $R^1$ is a $C_1$–$C_6$ alkyl group such as a methyl group or a $C_6$–$C_{12}$ aryl group such as a phenyl group, which may be different from each other, and $R^2$ is a $C_6$–$C_{200}$ saturated hydrocarbon group, provided that the carbon number of $R^2$ is larger than the carbon number of $R^1$.

7 Claims, No Drawings

ELECTROSTATIC IMAGE DEVELOPING TONER

BACKGROUND OF THE INVENTION

1. Field of the Invention

The present invention relates to an electrostatic image developing toner used for an electrophotographic system copying machine and a printer. Particularly, the present invention relates to an electrostatic image developing toner having satisfactory fixing properties usable in a wide fixing temperature range, which does not cause an offset phenomenon, a sheet-wrapping phenomenon or the like when it is fixed by heat roller fixing method which does not use an offset-preventing liquor such as a silicone oil or the like and which provides satisfactory gloss, transparency and anti-blocking properties.

2. Discussion of Background

As disclosed in U.S. Pat. No. 2,297,691, JP-B-42-23910 and JP-B-43-24748, an electrophotographic method generally comprises forming an electrostatic latent image on a photoreceptor containing a photoconductive material by various means, developing the latent image with a toner to provide a powder image, transferring the toner powder image to paper or the like if necessary, and then fixing by heating, pressurizing or solvent vapor. Examples of the heat fixing method include oven fixing method, flash fixing method, pressure fixing method, heat roller fixing method and the like, but it is usual for an electrophotographic copying machine or the like to employ the heat roller fixing method. According to this method, a heat efficiency is quite satisfactory when a toner image is fused on a fixing sheet such as paper, an overhead project sheet and the like, and since fixing can be rapidly effected, this method is quite effective as a fixing method for copying at a high velocity. However, there are problems of causing a sheet-wrapping phenomenon and an offset phenomenon that a part of a toner image is deposited on the surface of a fixing roller since the toner image in heat-melted state is made contact with the surface of a fixing roller under pressure and the part of the toner image deposited on the surface of the fixing roller is transferred to next fixing sheet; thus producing a dirty image on the fixing sheet. Heretofore, in order to prevent the offset phenomenon and the sheet-wrapping phenomenon, the surface of a roller was made of such a material as a silicone rubber or a fluorine-resin excellent in releasability to a toner, and its surface was supplied with such a liquid as a silicone oil having a satisfactory releasability to coat the roller surface with its thin film. However, this method is effective for preventing an offset phenomenon and a sheet-wrapping phenomenon, but has problems of making a fixing device complicated since it requires a device for supplying a liquid, making sheet delivery unsatisfactory due to the presence of a silicone oil when printing on both sides, and making the surface of a sheet for an overhead projector sticky. Therefore, it has been proposed in JP-B-52-3304, JP-B-60-17109, JP-B-57-52574 and JP-B-58-58664 to provide a method for forming the surface of a roller from such a material as a fluorine type resin excellent in releasability to a toner and using a toner containing an olefin type wax such as a low molecular weight polyolefin or a low molecular weight polyethylene, as a method for preventing an offset phenomenon without supplying an offset-preventing liquor such as a silicone oil to the surface of a fixing roller, and also it has been proposed in JP-B-55-6895 to provide a method of using a resin having a wide molecular weight distribution as a binder. However, these methods are effective for preventing the sheet-wrapping phenomenon and the offset phenomenon at a high temperature zone, but they do not provide satisfactory performances in respect of gloss and transparency of a mixed color in the case of using a full color toner.

Also, a method for using polysiloxanes in place of a silicone oil or an olefin type wax, is known.

For example, JP-A-7-120962 discloses a toner using such a polysiloxane as illustrated below in place of an olefin type wax or in combination with an olefin type wax:

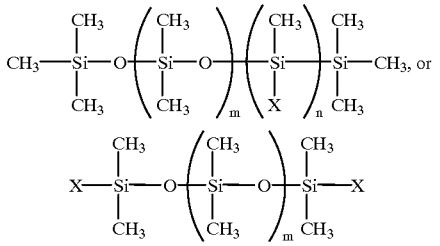

(X is a polyether group, and ester group or an alkoxy group).

Further, JP-A-9-190009 discloses a toner using a polysiloxane of the formula:

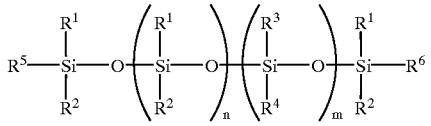

($R^1$–$R^4$ are a $C_1$–$C_6$ alkyl group, and $R^5$ and $R^6$ are a $C_{16}$–$C_{600}$ saturated hydrocarbon group).

These prior arts provide an improved transparency, but are not satisfactory in respect of anti-blocking properties and a fixing temperature range which does not cause an offset phenomenon.

The present inventors have intensively studied the above mentioned problems, and as a result of the study, they have discovered that above mentioned problems can be solved by using a specific polysiloxane having a higher alkyl group introduced into a side chain. The present invention has been completed on the basis of this discovery.

SUMMARY OF THE INVENTION

Thus, the present invention provides an electrostatic image developing toner containing a polysiloxane having the following repeating units (a) and (b):

(a)

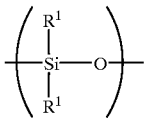

(b)

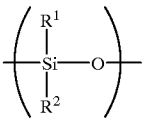

wherein $R^1$ is a $C_1$–$C_6$ alkyl group or a $C_6$–$C_{12}$ aryl group, which may be different from each other, and $R^2$ is a $C_6$–$C_{200}$ hydrocarbon group, provided that the carbon number of $R^2$ is larger than the carbon number of $R^1$.

DETAILED DESCRIPTION OF THE INVENTION

Hereinafter, the present invention is described in more details.

$R^1$ is a $C_1$–$C_6$ linear or branched alkyl group or a $C_6$–$C_{12}$ aryl group, preferably a $C_1$–$C_6$ alkyl group, a phenyl group or a naphthyl group, more preferably a $C_1$–$C_4$ alkyl group or a phenyl group, most preferably a methyl group.

$R^2$ is a linear or branched hydrocarbon group having an average carbon number of from 6 to 200, preferably a linear or branched saturated hydrocarbon group having an average carbon number of from 12 to 100, preferably from 16 to 80. However, the carbon number of $R^2$ is larger than the carbon number of $R^1$. If the average carbon number is less than 6, it becomes oil-like, and the toner causes blocking or the fluidity of the toner is lowered. The polysiloxane has a melting point of preferably from 30 to 150° C., more preferably from 55 to 130° C. If the melting point is lower than 30° C., the toner does not provide a satisfactory blocking resistance, and if the melting point is higher than 150° C., a releasing effect is unsatisfactory.

The molar ratio of the repeating unit (b)/the total units (a)+(b) is not specially limited, but is preferably ¾–1/50, more preferably ½–1/30.

The polysiloxane is added preferably in an amount of from 1 to 30 parts by weight to 100 parts by weight a binder resin, but in the case of a pulverized toner, its amount is preferably from 1 to 15 parts by weight, more preferably from 1 to 8 parts by weight. In the case of a polymeric toner, its amount is preferably from 1 to 25 parts by weight, more preferably from 1 to 20 parts by weight. If the amount of the polysiloxane is less than 1 part by weight, releasability and offset resistance become poor, and if the amount of the polysiloxane is more than 30 parts by weight, blocking resistance of the toner is lowered.

The average molecular weight of the polysiloxane is not specially limited, but preferably from 15,000 to 80,000, more preferably from 20,000 to 60,000, most preferably from 24,000 to 50,000. When the molecular weight is less than 15,000, it becomes oil-like and the toner causes blocking and the fluidity of the toner tends to be lowered. On the other hand, if the molecular weight is too large, a releasing effect tends to be poor.

The term "average molecular weight" used herein is a molecular weight calculated from the presence ratio of terminal Si and the presence ratio of repeating units (a) and (b) measured by $^{29}$Si-NMR.

The binder resin used in the present invention is not specially limited, but its examples include styrene/acryl type resin, epoxy type resin, polyester type resin and the like. A molecular weight distribution used includes both of one peak-distribution and two or more peak-distributions, but when the binder is used for a color toner, a total amount of a polymeric component having a molecular weight of at least 400,000 and a gel component insoluble in THF is preferably at most 10 wt %, more preferably at most 3 wt %, most preferably at most 1 wt %, to the total resin. If the total amount of the component having a molecular weight of at least 400,000 and the gel component is too large, glossiness and a color reproducibility when projecting an image on an OHP sheet become poor.

A method for adding the polysiloxane to the toner depends on a production method of the toner, but when the toner is produced by pulverizing method, the polysiloxane may be previously dissolved or dispersed in a binder or may be added at the same time as kneading with a coloring agent and the like. Examples of the method for previously adding the polysiloxane include a method comprising dissolving or suspending a binder resin and the polysiloxane in an organic solvent and removing the solvent by distillation under reduced pressure or a method comprising adding the polysiloxane to a monomer in a process of polymerization of a binder resin and then polymerizing.

In the case of suspension polymerization method, the polysiloxane is added by a method comprising adding the polysiloxane to a polymerizable monomer at the same time as adding a coloring agent, a charge controlling agent, a polymerization initiator and other additives, uniformly dissolving or dispersing the monomer system by a homogenizer, dispersing the monomer system into an aqueous type medium containing a dispersion stabilizer by a homomixer and then heating to carry out polymerization.

In the case of emulsion polymerization agglomeration method, the polysiloxane is added by a method comprising agglomerating an emulsified polymer and the emulsification-dispersed polysiloxane or by a method comprising emulsion-polymerizing a polymerizable monomer in the presence of the polysiloxane to obtain an emulsified polymer containing the polysiloxane and agglomerating it.

Examples of a coloring agent include carbon black, nigrosine, aniline blue, phthalocyanine blue, phthalocyanine green, hansa yellow, rhodamine type dye and pigment, chrome yellow, quinacridon, benzidine yellow, rose bengal, triarylmethane type dye, monoazo type, disazo type and condensed azo type dye and pigments. These known dye and pigments can be optionally used alone or in a mixture. In the case of a full color toner, it is particularly preferable to use benzidine yellow, monoazo type dye and pigment or condensed azo type dye and pigment as a yellow coloring agent, to use quinacridon, rhodamine type dye and pigment or monoazo type dye and pigment as a magenta coloring agent and to use phthalocyanine blue as a cyan coloring agent, but the present invention is not limited thereto. The coloring agent is used usually in an amount of from 3 to 20 parts by weight to 100 parts by weight of a binder resin.

Charge control of a toner may be effected by a binder resin and a coloring agent itself, but if necessary, they may be used in combination with a charge controlling agent. Examples of a positive charge controlling agent include a quaternary ammonium salt, a basic and electron-donative organic material and the like, and examples of a negative charge controlling agent include metal chelates, an alloy dye, an acidic or electron-attractive organic material and the like. In the case of a color toner, when considering color toner applicability (a charge controlling agent itself is colorless or has only such a pale color as not to impair the color tone of a toner), it is preferable to use a quaternary ammonium salt compound as a positive charge controlling agent and to use a metal salt or metal complex of chromium, zinc or aluminum with salicylic acid or alkylsalicylic acid, a metal salt or metal complex of benzilic acid, an amide compound, a phenol compound, a naphthol compound and the like as a negative charge controlling agent. In addition, inorganic particles of metal oxides or inorganic materials surface-treated with the above mentioned organic materials may be used.

An amount of a charge controlling agent is determined by considering various conditions such as a chargeability of a binder resin, a production method including an amount of a coloring agent and a dispersion method, chargeablities of other additives, and the like, but it is suitable to use a charge controlling agent in an amount of from 0.1 to 10 parts by weight to 100 parts by weight of a binder resin.

The toner used in a present invention comprises essentially the above mentioned binder resin, coloring agent and charge controlling agent, but if necessary, it may contain further a wax and other components. Examples of the wax to be used include a olefin type wax, preferably a low molecular weight polypropylene, a paraffin wax, a higher aliphatic acid, an aliphatic amide, a metal soap and other wax. The amount of a wax used may vary depending on a binder, a coloring agent and the like, but is preferably from 0.1 to 10 parts by weight to 100 parts by weight of a binder. However, in the case of a color toner, when a wax is used in a large amount, it sometimes impairs transparency due to crystallinity of wax depending on a combination with a binder resin, and therefore it is not preferable to use a wax in an excessive amount.

In addition to the above components, a fluidity-improving agent such as fine powdery silica, alumina and titania, an inorganic fine powder such as magnetite, ferrite, cerium oxide, strontium titanate and electroconductive titania, a resistance-controlling agent such as styrene resin and acryl resin and a lubricant may be used as an inner additive or an outer additive. The amount of these additives may be optionally selected depending on an aimed property, and is usually from 0.05 to 10 wt % to 100 parts by weight of a binder resin.

The toner of the present invention may be used for any of dry system one-component developer and two-component developer. Examples of a magnetic material used in the one-component developer include ferromagnetic alloys of iron, cobalt, nickel or the like such as ferrite, magnetite or the like, or alloys containing no such ferromagnetic elements or compounds but exhibiting a ferromagnetic property when appropriately heat-treated, e.g. alloys containing manganese and copper (called as Heusler's alloys) such as manganese-copper-aluminum or manganese-copper-tin, or chromium dioxide. The magnetic material is uniformly dispersed in a fine powder form having an average particle size of from 0.3 to 30 $\mu$m in a binder resin. The amount of the magnetic particles is preferably from 20 to 70 parts by weight, more preferably from 40 to 70 parts by weight, to 100 parts by weight of a binder resin.

When the toner of the present invention is used as a two-component type developer, examples of a carrier to be used include a magnetic material powder such as iron powder, magnetite powder and ferrite powder or these magnetic material powders coated with resin or a magnetic carrier and the like which are well known. Examples of a coating resin for the resin-coated carriers include styrene type resin, acryl type resin, styrene acryl copolymer type resin, silicone type resin, modified silicone type resin, fluorine type resin, or mixture of these resins, which are generally known.

EXAMPLES

Now, the present invention will be described in further details with reference to Examples. However, it should be understood that the present invention is by no means restricted to such specific Examples. In Examples, a molecular weight (number average molecular weight (Mn), weight average molecular weight (Mw)) of a tetrahydrofuran (THF)-soluble component of a binder resin, a melting point, a molecular weight of polysiloxane, an offset resistance and a blocking resistance were respectively measured in the following manner.

A molecular weight (number average molecular weight (Mn), weight average molecular weight (Mw)) of a tetrahydrofuran-soluble component of a binder resin was measured by gel permeation chromatography (GPC).

Apparatus: TOSO GPC Apparatus HLC-8020

Column: Polymer Laboratory-made PL-gel Mixed 10 $\mu$m

Reference Column: TOSO TSKgel GMH

Detector: Refractive-Index (RI) Detector

Analytical Curve

An analytical curve was prepared by using 11 kinds of standard polystyrenes (molecular weight=$2.6\times10^3$–$1.3\times10^6$) of Pressure Chemical Co.

Measurement

100 $\mu$l of a sample (concentration=0.1 wt %) was poured into tetrahydrofuran flowing at a rate of 1.0 ml/min. at a temperature of 40° C.

Melting Point

A sample was measured by DSC (DSC-20 manufactured by Seiko Denshikogyo K.K.), and its maximum heat-absorbing peak was taken as a melting point.

Molecular Weight of Polysiloxane

A molecular weight was measured by $^{29}$Si-NMR, and the constitution ratio of silicone main chain terminal·repeating unit (a)·repeating unit (b) was calculated.

Offset Resistance

An unfixed image was formed by an electrophotographic copying machine using an organic photoconductive material as a photoreceptor. The amount of a toner deposited was 0.7 mg/cm$^2$. This unfixed image was transferred to a paper, and was fixed at a nip width of 4 mm and at a fixing speed of 100 mm/sec. by using a heat-roller fixing machine having a diameter of 58 mm and having a surface of fluororesin. In the fixing process, an offset-preventing liquid such as a silicone oil was not supplied to the roller. A surface temperature of the fixing roller was varied by every 5° C., and non-offset zone was regularly evaluated to measure a non-offset temperature range.

Blocking Resistance

A predetermined amount of load was applied to a toner, and the toner was allowed to stand under an environment of 50° C. for 5 hours. Thereafter, occurrence of agglomeration was observed to evaluate a blocking resistance.

In the following Table, ○ indicates no occurrence of agglomeration,

Δ indicates such a state that an agglomeration occurs but is easily broken into powder when pressing with a finger, and X indicates occurrence of a substantial agglomeration.

Example 1

4 parts by weight of carbon black "MA-100" (manufactured by Mitsubishi Chemical Corporation), 5 parts by weight of charge controlling agent "Bontron E-81" (manufactured by Orient Kagaku K.K.) and 6 parts by weight of polysiloxane (melting point 50° C., average molecular weight 27,000) having the following repeating unit obtained by distilling off a solvent from trade name "FZ-3340" (manufactured by Nihon Unicar K.K.) were dispersed and mixed with 100 parts by weight of resin A (styrene/acryl type, Mn 18,000, Mw 48,000), and the mixture was melt-kneaded by a biaxial extruder.

(a')

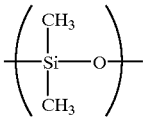

(b')

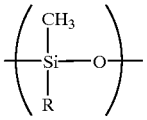

(R is a hydrocarbon group having a carbon number of 36, and a':b' is about 14:1).

After cooling, the above kneaded product was pulverized by a hammer mill, and was further finely powdered by an ultrasonic jet mill grinder. The powder thus obtained was classified by a wind force classifier to obtain a toner having an average particle size of 11 $\mu$m. To 100 parts by weight of the above obtained toner, was added and mixed 0.3 part by weight of trade name "Aerosil R-972" (manufactured by Nihon Aerosil K.K.) to obtain a toner of the present invention.

Example 2

A toner was obtained in the same manner as in Example 1, except that resin A was replaced by resin B (polyester type, Mn 9,000, Mw 31,000).

Example 3

A toner was obtained in the same manner as in Example 1, except that the polysiloxane was replaced by polysiloxane (melting point 33° C., average molecular weight 22,000) having the following repeating unit:

(a')

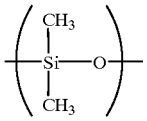

(b")

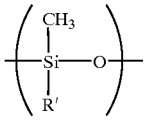

(R' is a hydrocarbon group having a carbon number of 18, and a':b" is about 2:1).

Comparative Example 1

A comparative toner was obtained in the same manner as in Example 1, except that the polysiloxane was not added.

Comparative Example 2

It was tried to obtain a toner in the same manner as in Example 1, except that the polysiloxane was replaced by a silicone oil which is oil-like at normal temperature and is supplied to a fixing roller for a printer of oil feed fixing system, but the pulverized toner was deposited in the inside of an ultrasonic jet mill grinder at the time of finely grinding, and was not recovered.

Comparative Example 3

A toner was obtained in the same manner as in Example 1, except that 6 parts by weight of the polysiloxane was replaced by 0.5 part by weight of a silicone oil which is oil-like at normal temperature.

Comparative Example 4

A toner was obtained in the same manner as in Example 1, except that the polysiloxane was replaced by propylene wax "Viscol 550P" (manufactured by Sanyo Kasei K.K.).

Comparative Example 5

A toner was obtained in the same manner as in Example 1, except that the polysiloxane was replaced by polysiloxane having the following repeating unit:

(a')

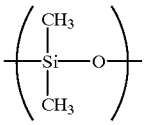

(c)

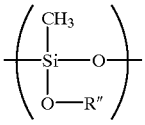

(R" is a long chain alkyl group having a melting point of 50° C.).

Comparative Example 6

A toner was obtained in the same manner as in Example 1, except that 6 parts by weight of the polysiloxane was replaced by 1.5 parts by weight of the polysiloxane used in Comparative Example 5 and 4.5 parts by weight of paraffin wax.

TABLE 1

| | Non-offset temperature range | Blocking resistance |
|---|---|---|
| Example 1 | 145 to 170° C. | ○ |
| Example 2 | 140 to 165° C. | ○ |
| Example 3 | 140 to 170° C. | Δ |
| Comparative Example 1 | None | ○ |
| Comparative Example 2 | It was possible to evaluate a toner | |
| Comparative Example 3 | 155° C. | ○ |
| Comparative Example 4 | 155 to 180° C. | ○ |
| Comparative Example 5 | 130 to 135° C. | Δ |
| Comparative Example 6 | 135 to 150° C. | ○ |

As evident from the above Table 1, the toners of the present invention have satisfactory non-offset temperature ranges even in heat roller fixing system without using an offset-preventing liquid such as a silicone oil, and are excellent also in blocking resistance and fluidity. On the other hand, the comparative toners which do not contain the specific polysiloxane of the present invention are poor in various properties. That is, Comparative Example 1 containing no polysiloxane is poor in offset resistance and releasability, Comparative Example 2 containing an oil-like silicone oil in place of the specific polysiloxane is poor particularly in fluidity, Comparative Example 3 in which an amount of silicone oil is reduced has an improved fluidity but is poor in offset resistance and releasability, and Comparative Example 4 containing polypropylene wax in place of the specific polysiloxane is poor in fixing property at a low temperature.

As mentioned above, the present invention provides an excellent toner having satisfactory non-offset temperature ranges even in heat roller fixing method without using an offset-preventing liquid such as a silicone oil and also having satisfactory blocking resistance and fluidity.

What is claimed is:

1. An electrostatic image developing toner containing a polysiloxane having the following repeating units (a) and (b):

(a)

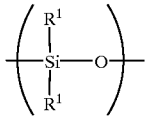

(b)

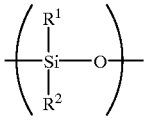

wherein $R^1$ is a $C_1$–$C_6$ alkyl group or a $C_6$–$C_{12}$ aryl group, which may be different from each other, and $R^2$ is a $C_{12}$–$C_{100}$ saturated hydrocarbon group, provided that the carbon number of $R^2$ is larger than the carbon number of $R^1$.

2. The electrostatic image developing toner according to claim 1, wherein $R^1$ is a methyl group.

3. The electrostatic image developing toner according to claim 1, wherein the proportion of the repeating unit (b) is (b)/(a)+(b)=¾–1/50.

4. The electrostatic image developing toner according to claim 1, wherein the polysiloxane has a melting point of from 30° C. to 150° C.

5. The electrostatic image developing toner according to claim 1, wherein the polysiloxane is contained in an amount of from 1 to 30 parts by weight to 100 parts by weight of a binder resin.

6. The electrostatic image developing toner according to claim 1, wherein the polysiloxane has an average molecular weight of from 15,000 to 80,000 calculated from $^{29}$Si·NMR.

7. The electrostatic image developing toner according to claim 1, additionally containing a binder resin, wherein the binder resin is a polyester type resin or a styrene/acryl type resin, in which a total amount of a polymeric component having a molecular weight of at least 400,000 and a gel component insoluble in THF is at most 10 wt % to the total resin.

* * * * *